United States Patent [19]

Reiher

[11] 4,195,949

[45] Apr. 1, 1980

[54] METHOD AND APPARATUS FOR EMERGENCY TRANSFER AND LIFE SUPPORT OF SATURATION DIVERS

[75] Inventor: Max A. W. Reiher, Mandeville, La.

[73] Assignee: J. Ray McDermott & Co., Inc., New Orleans, La.

[21] Appl. No.: 925,551

[22] Filed: Jul. 17, 1978

[51] Int. Cl.[2] ..... B63C 11/00

[52] U.S. Cl. ..... 405/185; 405/186; 128/205.26; 128/202.12; 114/323

[58] Field of Search ..... 405/185, 186, 187, 188, 405/189, 190; 128/204, 1 R, 297, 298; 114/322, 323, 324, 312, 313

[56] References Cited

U.S. PATENT DOCUMENTS

| | | | |
|---|---|---|---|
| 962,019 | 6/1910 | Flood et al. | 405/192 |
| 1,008,301 | 11/1911 | Baker | 405/189 |
| 1,103,958 | 7/1914 | Griffin | 405/189 X |
| 1,159,683 | 11/1915 | Keller et al. | 405/185 X |
| 2,269,500 | 1/1942 | Wildhack | 128/204.25 |
| 2,299,109 | 10/1942 | Rand | 128/204.22 |
| 2,357,064 | 8/1944 | Wolf | 114/323 |
| 2,433,189 | 12/1947 | Amato | 114/323 |
| 2,469,367 | 5/1949 | Burgess et al. | 422/120 |
| 2,494,131 | 1/1950 | Jackson | 422/120 |
| 2,507,450 | 5/1950 | Millikan et al. | 128/202.26 |
| 3,071,530 | 1/1963 | Neville | 204/195 P |
| 3,088,810 | 5/1963 | Hay | 422/117 |
| 3,148,034 | 9/1964 | Bovard et al. | 422/120 |
| 3,208,449 | 9/1965 | Bartlett | 128/204.28 |
| 3,215,057 | 11/1965 | Turek | 98/1.5 |
| 3,277,890 | 10/1966 | Warncke | 128/205.12 |
| 3,299,645 | 1/1967 | Link | 405/193 |
| 3,323,312 | 6/1967 | Banjavich | 405/193 |
| 3,368,556 | 2/1968 | Jensen et al. | 128/201.21 |
| 3,403,612 | 10/1968 | Swet et al. | 98/1.5 |
| 3,410,191 | 11/1968 | Jackson | 98/1.5 |
| 3,443,906 | 5/1969 | McGoff | 422/122 |
| 3,478,769 | 11/1969 | Zavod et al. | 128/204 X |
| 3,593,711 | 7/1971 | Staub | 128/202.26 |
| 3,593,735 | 7/1971 | Reiher | 137/88 |
| 3,893,459 | 7/1975 | Mausteller et al. | 128/202.26 |
| 3,924,616 | 12/1975 | Banjavich et al. | 405/186 X |
| 3,924,618 | 12/1975 | Banjavich et al. | 405/186 X |
| 3,957,043 | 5/1976 | Shelby | 128/204 X |
| 4,011,867 | 3/1977 | Arntzen | 128/204 |

FOREIGN PATENT DOCUMENTS

| | | | |
|---|---|---|---|
| 721000 | 2/1932 | France | 114/322 |
| 294749 | 8/1928 | United Kingdom . | |
| 373045 | 5/1932 | United Kingdom . | |

OTHER PUBLICATIONS

"Deep Diving Equipment" by Siebe, Gorman & Co., Ltd., Davis Road, Chessington, Surrey, England.

"Atmosphere Control", Aerospace Engineering, vol. 19, No. 5, May, 1960, pp. 40, 41 & 94.

*Primary Examiner*—Dennis L. Taylor

*Attorney, Agent, or Firm*—Arnold, White & Durkee

[57] ABSTRACT

An emergency life-supporting capsule is disclosed for transferring saturation divers from a main decompression chamber on board a main support vessel. The capsule is attached to the main decompression chamber in anticipation of an emergency. The capsule is located opposite a diving bell on the decompression chamber. The capsule includes self-contained breathing systems for supporting occupants divers. In case of an emergency such as abandonment of the main support vessel or the main decompression chamber, the divers are transferred to the capsule which is sealed and separated from the main decompression chamber, lowered overboard, and allowed to float independently until a rescue vessel arrives. The capsule is then retrieved by the rescue vessel and reconnected to a main decompression chamber.

5 Claims, 11 Drawing Figures

METHOD AND APPARATUS FOR EMERGENCY TRANSFER AND LIFE SUPPORT OF SATURATION DIVERS

BACKGROUND OF THE INVENTION

This invention relates in general to pressurized or saturation diving, and more particularly relates to life support capsules used in saturation diving to rescue divers in an emergency situation.

Conventionally, in depths of over 200 feet a diver ascends to the surface at a very slow rate, normally on the order of 50 feet per hour to avoid "diver's palsy" or "bends". If dives are performed to depths of 600 or 700 feet, the time for ascension to the water surface becomes a very significant factor and may well develop into a problem.

To obviate these considerations, pressurized or saturation diving is employed to extend the permissible diving time by maintaining divers between dives at a preselected pressure representative of a specified water depth. In this manner, the diver may be readily transferred to and from the specific water depth without the need for decompression. Diving bells are used in saturation diving to transport the divers to and from the specific water depth. A main pressure chamber, also referred to as the main decompression chamber, is usually mounted on board a support vessel and attached to the diving bell for housing the divers between dives. In this manner, the divers can live in a pressurized condition similar to the preselected hydrostatic pressure for days, even weeks, without the need to decompress. The time saved from not having to pressurize and decompress repeatedly can be a significant cost factor in offshore operations.

There are many prior publications relating to the field of diving bells. Generally, as described in these publications, the diver is initially pressurized to the preselected hydrostatic pressure within the main decompression chamber. He is then transferred to a diving bell under the same pressure and lowered overboard to the preselected depth. Once on location, he is able to emerge from the bell and work for an indefinite period in only a wet suit. Breathing gas is normally supplied to the diver via a hose from the bell. Upon completion of his work, the diver ascends to the surface in the bell under the same pressure. Once on board the parent support vessel, the bell is reconnected to the main decompression chamber.

However, if an emergency arises on board the support vessel which requires either the abandonment of the vessel or the main decompression chamber, the diver may not be able to decompress in time to emerge safely from the main decompression chamber. In addition, the diver may neither be able to enter the diving bell and descend below the surface since the support vessel secures the diving bell and generally provides the breathing gas to the bell via hoses. Furthermore, if the main decompression chamber is damaged, the diver is equally vulnerable to the "bends" since he may not be able to transfer to an emergency capsule maintained at the same pressure as the decompression chamber. The diving industry has recognized the need for a solution to these problems.

SUMMARY OF THE INVENTION

This invention satisfies the indicated need by providing a novel method and apparatus for housing saturation divers during emergencies on a parent support vessel. An emergency capsule is provided, and the capsule can be rendered overboard the support vessel and allowed to float freely at the water surface until a rescue vessel arrives or until a main decompression chamber is repaired or replaced. In addition, the invention provides an emergency escape from the main decompression chamber for maintaining a breathing environment for the saturation diver should the breathing gas of the main decompression chamber become contaminated.

According to one aspect of the invention, the emergency capsule includes a shell structure which defines at least one exit and which supports a self-contained breathing system. The exit is sealingly coupled to an exit of the main decompression chamber. The self-contained breathing system supplies breathing gases to the saturation diver or divers while the capsule is floating on the open seas.

The breathing system includes two self-contained subsystems and a third subsystem which is dependent on the presence of the support vessel. The first self-contained subsystems include an oxygen supply which is attached to the bottom of the capsule and which is activated by the crew of the support vessel prior to lowering the capsule overboard. The second self-contained subsystem includes a regenerating potassium superoxide ($KO_2$)/carbon dioxide ($CO_2$) chemical cannister reaction system housed within the shell. The dependent subsystem includes a pre-mixed combination of helium and oxygen supplied directly to the shell from a mixing tank system onboard the support vessel. Hence, the subsystem is used only when the main decompression chamber is abandoned.

The invention also includes a floatation and stabilization ring attached to the upper portion of the capsule. Since the capsule is designed to float in an upright manner and has a tendency to rock due to a low center of gravity, the ring is positioned on the capsule at or above the water surface. This stabilizes the rocking motion of the capsule.

As another feature of this invention, a plurality of elongated members are provided for supporting the capsule in an upright manner while it is onboard the support vessel. Each member includes a levelling mandrel for accurately aligning the connecting flanges of the capsule and the main decompression chamber, thereby assuring a proper seal.

It is, therefore, a general object of the present invention to provide a novel and improved method and apparatus for supporting saturation divers safely in a pressurized environment.

The more important features of the invention have been summarized rather broadly in order that the detailed description which follows may be better understood and appreciated. Additional features of the invention will be more fully described hereinafter.

BRIEF DESCRIPTION OF THE DRAWINGS

In order that the features and advantages of the invention may be better understood, a detailed description of a preferred embodiment of the invention, as illustrated in the appended drawings, follows. It shall be noted that the description and the appended drawings are not to be considered limiting the scope of the invention. The invention may admit to other equally effective embodiments without departing from its spirit and scope.

In the drawings.

DETAILED DESCRIPTION OF A PREFERRED EMBODIMENT

Introduction

Figure 1:
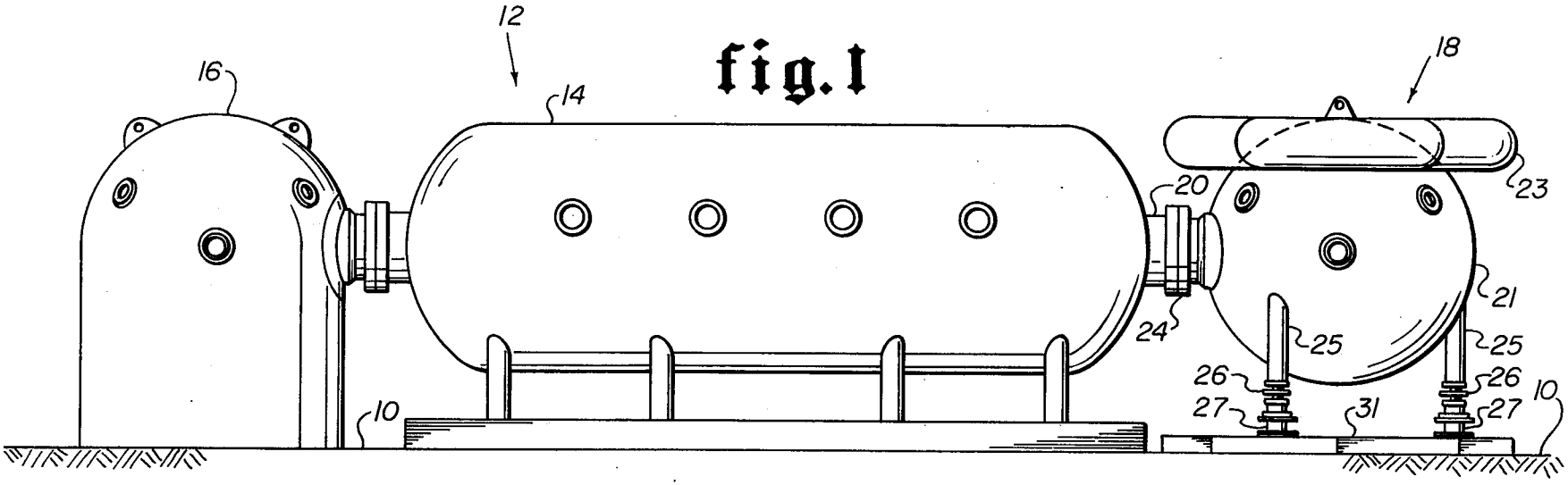
FIG. 1 schematically depicts an elevation view of an emergency capsule connected to a main decompression chamber which is in turn connected to a diving bell.

Referring to FIG. 1, a parent support vessel is represented as having a deck 10. The vessel is adapted for the practice of saturation diving. The deck 10 may also be that of a fixed offshore platform rather than a floating vessel. A saturation diving system 12, which includes a main decompression chamber 14, a diving bell 16, and an emergency capsule 18 is supported on the deck 10. Should life support systems of the chamber 14 fail, the capsule 18 is available for maintaining a life supporting environment to saturation divers who otherwise would be staying within the chamber 14.

The main decompression chamber 14 is used between dives to house saturation divers in a pressurized environment compatable with that of the preselected hydrostatic pressure at the depth that the diver is working. The chamber includes all the facilities necessary to comfortably support several divers for an indefinite length of time.

The diving bell 16 is attached to one end of the main chamber 14. The bell 16 is used to transport the divers to and from the working depth and is maintained at the preselected hydrostatic pressure corresponding to that of the working depth. Accordingly, the divers may exit the bell 16 when they reach the desired depth and work comfortably, hampered only by a breathing gas supply hose from the bell 16 to each diver. There is no need, therefore, when the diver reenters the bell to control the ascent of each diver as required in a conventional diving procedure to avoid the "bends".

The emergency capsule 18 provides an alternate life supporting environment to the saturation divers independently of the chamber 14 and bell 16. It is supported on the deck 10 and is connected via a passageway 20 to the main chamber 14 on the end opposite that of the diving bell 16. The passageway 20 includes a set of connecting flanges 24 sealably coupling the capsule 18 to the main chamber 14. Depending on the shape of the main chamber 14, the capsule 18 may be positioned in various positions with respect to the main chamber. For example, both the bell 16 and the capsule 18 may be adjacent one another on the same side of the main decompression chamber. Preferably, the capsule 18 is oriented as shown in FIG. 1 opposite the diving bell 16.

THE EMERGENCY CAPSULE 18

The capsule 18 comprises a shell 21, a support assembly 22 for supporting the shell 21 on the deck 10, and a stabilization ring 23 for stabilizing the shell 21 when it is floating in the open seas. The capsule 18 also includes a breathing system for maintaining breathing gasses within the shell 21.

The shell 21 is preferably spherical in shape. However, various other types of shapes are also feasible; for example, the shell 21 may be cylindrical or other suitable in shape. The principle structural requirement affecting the shape of the shell is the internal pressure. The structural design of the shell 21 itself follows the same general design criteria of the bell 16. The shell 21 is designed to withstand an internal pressure of 668 psi which is equivalent to 1500 feet of salt water, but the pressure rating could be higher or lower.

Referring now to FIGS. 5-9 in addition to FIG. 1, the support assembly 22 includes sets of elongated tubular members 25, levelling mandrels 26, end adapters 27 and includes a base skid 31. Each elongated member 25 is attached at one of its ends to the lower portion of the shell 21 and at its other end to the adapter 27 or to the base skid 31. One of the levelling mandrels 26 is located within each elongated member 25 and the mandrel 26 may be said to divide the member 25 into an upper end portions 25A and a lower end portions 25B.

In joining the capsule 18 to the main chamber 14, it is necessary that the connecting flanges 24 be properly aligned and provide an airtight seal between the capsule 18 and the chamber 14. The connecting flanges 24 include an O-ring seal (not shown) to provide proper sealing within a pressure range from atmospheric to approximately 668 psi. The design of the flange 24 and seal is conventional, being similar to the connecting flange between the main chamber 14 and the bell 16. For alignment purposes the capsule 18 is adjustable within the vertical and horizontal and angular directions. The support assembly 22, in particular the mandrels 26, provides this alignment.

Figure 5:
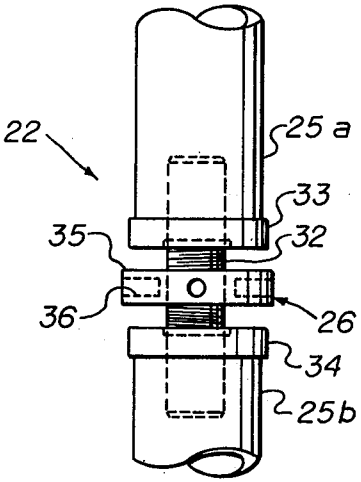
FIG. 5 is an enlarged elevation view illustrating a levelling mandrel used in connection with the emergency capsule.
Figure 3:
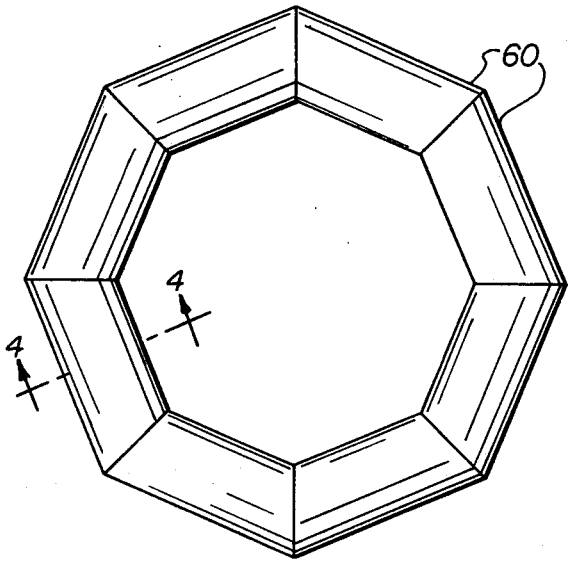
FIG. 3 is a plan view of the ring of FIG. 2.
Figure 2:
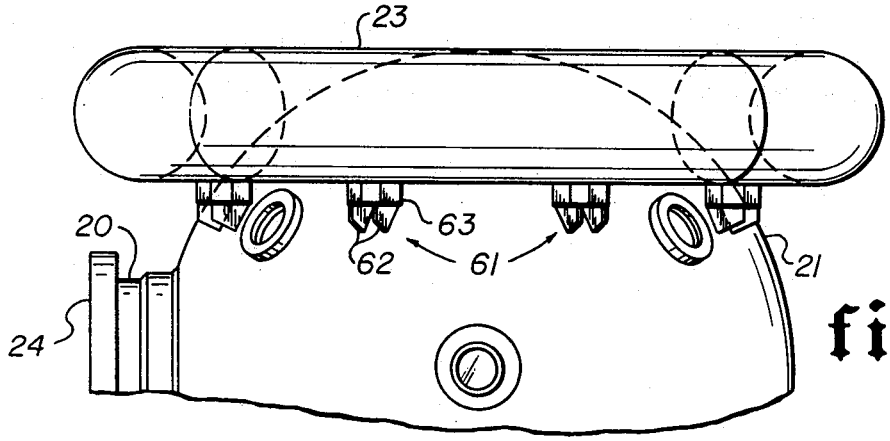
FIG. 2 is an elevation view of a floatation and stabilization ring mounted atop the capsule.
Figure 4:
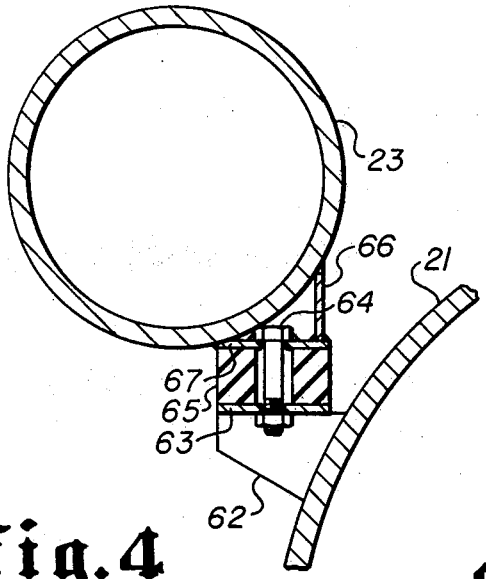
FIG. 4 is a sectional view through the ring of FIG. 3 illustrating the tie-down bracket connecting the ring to the emergency capsule.

Referring specifically to FIG. 5, each of the mandrels 26 includes a threaded shaft 32. The lower end of the upper end portion 25A of member 25 includes a first threaded collar 33 adjacent the mandrels 26. The upper end of the lower end portion 25B includes a second threaded collar 34 adjacent the mandrels 26. The upper portion of the threaded shaft 32 has right-hand threads which mate with threads of the first collar 33. The bottom portion of the threaded shaft 32 has left-hand threads which mate with threads of the second collar 34.

A protruding section 35, which is an integral part of the shaft 32, is located approximately midway of the shaft. A set of holes 36 are provided in the section 35 and are radially spaced at approximately ninety degrees to one another along the periphery of the protruding section 35. By inserting a rod (not shown) within one of the holes and rotating the shaft either clockwise or counterclockwise, the members 25 may either be shortened or extended. In this manner, the capsule may be lowered, raised, or reorientated angularly to properly align the connecting flanges.

Figure 8:
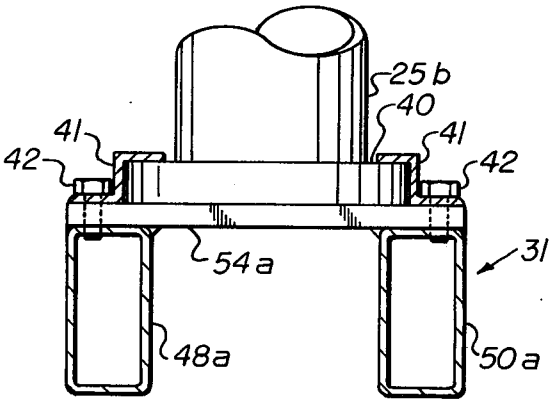
FIG. 8 is a partial sectional view taken through the base skid of FIG. 6 illustrating the attachment of the elongated support member to the base skid.
Figure 7:
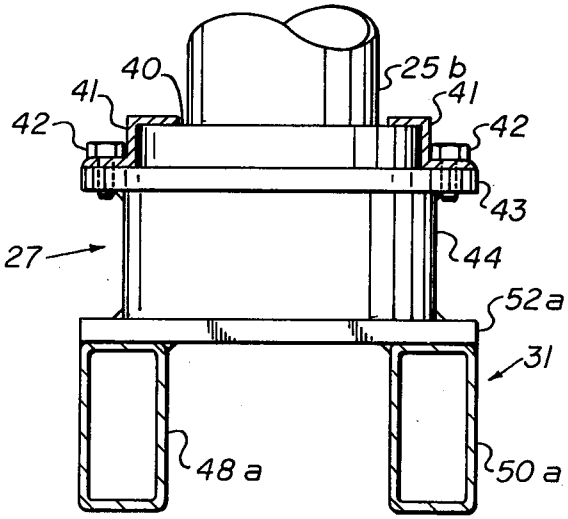
FIG. 7 is a partial sectional view through the base skid of FIG. 6 illustrating the adapter attached to the base skid and the elongated support member.

Referring to FIGS. 7 and 8, the end adapter 27 supports the elongated member 25 above the base skid 31. If the linear displacement required of the levelling mandrel 26 exceeds the length of threads available on the shaft 32, the adapters 27 may be employed to effectively extend the length of the elongated member. For example, the shaft 32 may be threaded for a maximum displacement of six inches between the first and second collars 33 and 34. If the elongated member 25 needs to be elevated more than the available six inches, the adapter 27 is inserted between the lower end 25B of the member 25 and and the base skid 31.

A base plate 40 is provided on the lower end 25B. The base plate 40 may contact either the skid 31 or adapter 27. The plate 40 is secured to the skid or adapter by a tie-down arrangement which includes a plurality of clips 41 and bolts 42 arranged peripherally about the plate 40.

Each adapter 27 includes a top plate 43 and a tube 44. Each of the clips 41 is secured to the plate 43 by a set of the bolts 42. The plate 43 is mounted to the tube 44 which in turn is attached to the base skid 31.

Figure 6:
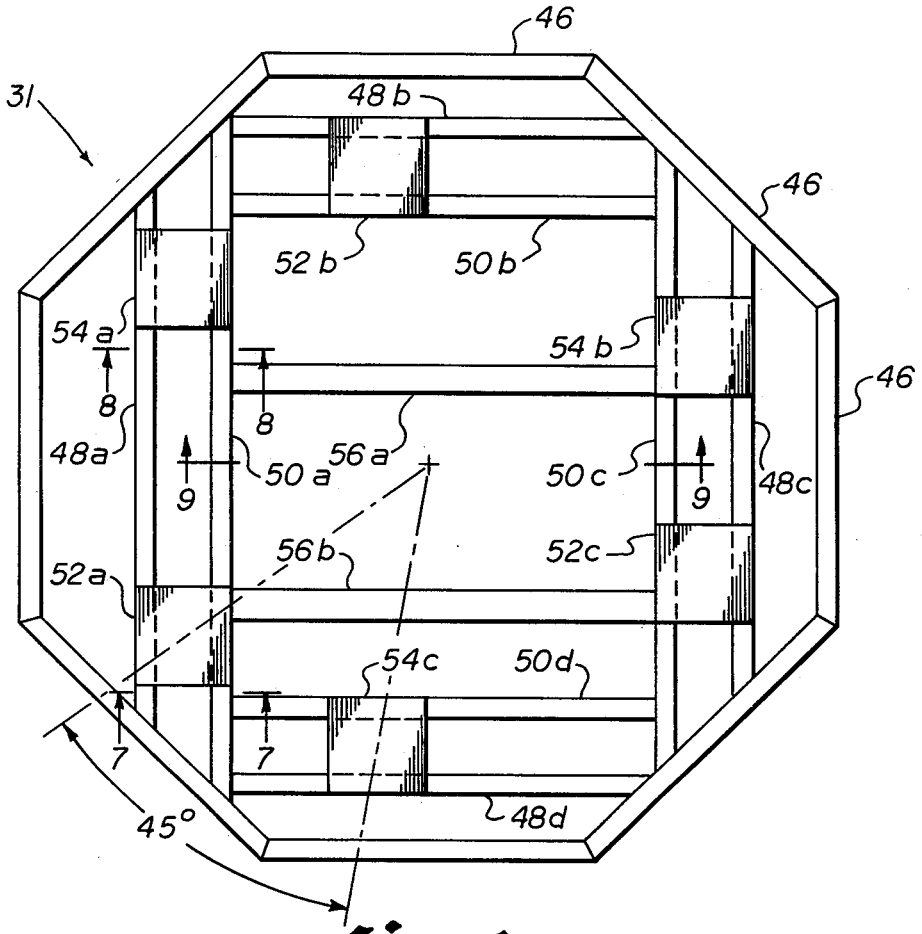
FIG. 6 is a plan view of the base skid supporting a set of elongated support members.
Figure 9:
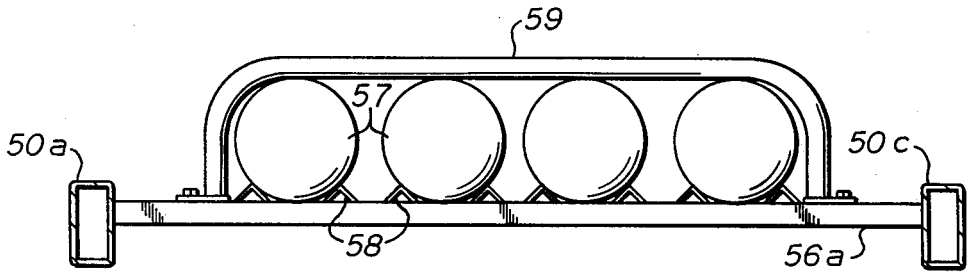
FIG. 9 is a partial sectional view taken through the base skid of FIG. 6 illustrating the oxygen tie-down brackets.

Referring to FIG. 6, the base skid 31 provides foundation support for the capsule while on board the support vessel. The base skid 31 includes sets of interconnected tubular members 46, intercoastals 48A–D, 50A–D, plates 52A–C, 54A–C and channels 56A–B. The tubular members 46 form the periphery of the skid 31. The intercoastal 48A is mounted on the interior of the skid 31 and attaches to two of the peripheral members 46. The intercoastal 50A is also mounted on the interior of the skid 31 adjacent and parallel to the intercoastal 48A.

In a similar manner, the intercoastals 48B and 50B, 48C and 50C, 48D and 50D are mounted on the interior of the base skid 31. Each pair of the intercoastals provides support for a plate 52 which in turn supports one of the adapters 27 and/or provides support for a plate 54 which in turn supports the base plate 40 of the elongated member 25. Each plate 52, which is attached to a tube 44 of the adapter 27, is mounted 45° clockwise of an adjacent plate 54.

The channels 56A and 56B are connected to the intercoastals 50A and 50C. The channels 56A and 56B provide support for oxygen bottles used in the breathing system of the capsule 18.

While only three (3) elongated support members 25 are shown in FIG. 1, obviously, more than three support members may be used. With three support members, however, the levelling procedure is simplified by having to adjust a minimum number of levelling mandrels. Therefore, with respect to FIG. 6, three locations are shown for bolting the capsule to the adapters 27 which in turn are welded to the plates 52A–C. In addition, the plates 54A–C are shown in three locations 45° counterclockwise of the plates 52A–C. By disconnecting the elongated support members 25 from the adapters 27 and rotating the shell 45° counterclockwise, the elongated members 25 may be reconnected to the plates 54A–C. In this manner, the height of the passageway 20 above the deck 10 is reduced. The capsule 18 would then be reoriented to co-axially align the passageways from the capsule and main chamber. The precise alignment between the connecting flanges 24 is accomplished by the levelling mandrel 26. In essence, the levelling mandrel is a fine tune adjustment.

Similarly, the capsule may be disconnected from the plates 54A–C, rotated 45° clockwise and connected to the adapters 27. In this manner, the height of the passageway 20 above the deck 10 is increased. The capsule would again be reoriented to coaxially align the passageways between the capsule 18 and main chamber 14. The system of adapters 27 as provided for is a fast and efficient method for altering the height of the passageway.

If desirable, several sets of adapters 27 of various lengths may be supported on the skid to offer a selection in the height of the passageway. For example, three or four positions may be available along the periphery of the skid wherein the length of each set of adapters varies from 1–4 ft. The work crew may decide any number of possible positions for roughly adjusting the height of the passageway.

If the deck 10 is uneven such that a significant differential occurs between any two support members, an individual adapter 27 may be installed under a specific elongated member 25 to prevent exceeding the six inch limitation of the threaded shaft 32. Accordingly, variations of the above described structures are possible.

The support assembly also includes sets of retainers 58 and bars 59 to restrain a set of oxygen containers 57 used for life support in the capsule 18. As discussed above, the channels 56A and 56B are connected to intercoastals 50A and 50C. The retainers 58 are strategically attached atop the channels 56A and 56B to prohibit lateral movement of the oxygen bottles. The bar 59 wraps around the oxygen bottles connecting to the channel 56A by means of a bolt. A similar bar attaches to the channel 56B (not shown).

Referring to FIGS. 1–4, the stabilizing ring 23 is attached to the upper portion of the shell 21. It is preferably attached at or above the water level when the capsule 18 is floating in the open seas. This stabilizes the capsule 18, as otherwise it has a tendency to rock when floating.

The stabilizing ring 23 includes a plurality of elongated tubular members 60 arranged in a polygon shape. The ring 23 is connected to the shell 21 by tie-down brackets 61.

Each of the brackets 61 includes two vertical plates 62 and a horizontal plate 63. The vertical plates 62 are attached to the shell 21, while the horizontal plate 63 is attached to the shell and the vertical plates 62.

In addition, each of the brackets 61 includes a bolt 64, a rubber cushion 65, and a set of plates 66 and 67 which are mutually perpendicular. The plate 67 is connected to the horizontal plate 63 by the bolt 64. The rubber cushion 65 is secured between the plates 63 and 67 to absorb differential movement due to wave and wind forces between the ring 23 and the shell 21. A rubber hardness of 70 to 90 durometers is preferable since the cushion should be hard enough to prevent excessive deflections yet soft enough to absorb wave forces against the ring 23.

The capsule 18 is also equipped with a sliding door (not shown) to seal the shell 21 from the passageway 20. The door is suspended from a trolley which is supported on a track mounted to the interior surface of the shell 21. The divers need only slide the door to provide an opening which permits egress and ingress. A seal (not shown), but preferably achieved by an O-ring, is provided by peripheral contact of the door against the inner surface of the shell 21 when the pressure inside the shell 21 exceeds the pressure in the passageway 20.

THE BREATHING SYSTEM 104

Figure 10:
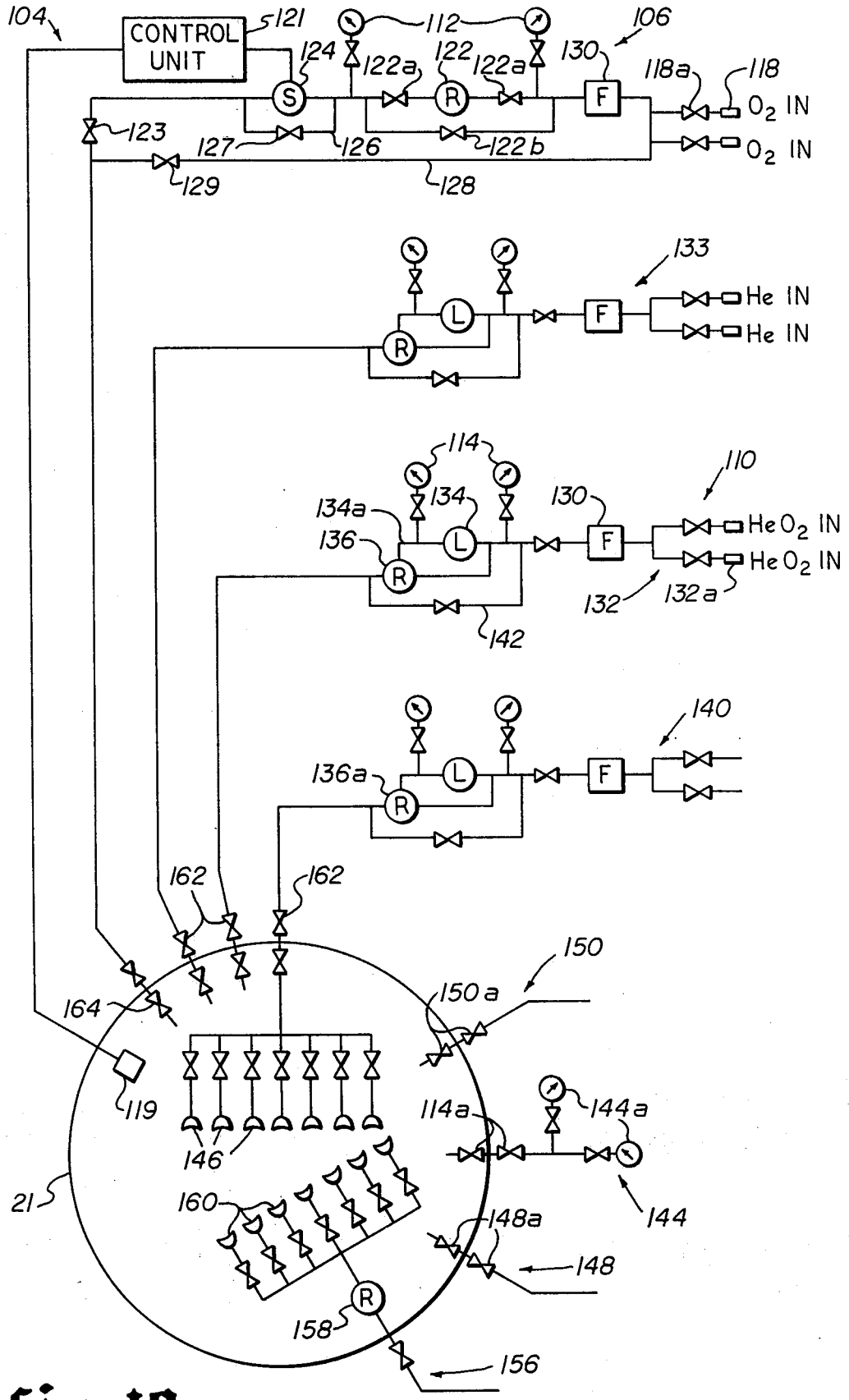
FIG. 10 is a schematic diagram of the plumbing used in a breathing system in connection with the emergency capsule.

The capsule 18 also includes a breathing system 104 for sustaining the divers at sea or on board the support vessel when the main decompression chamber 14 is abandoned. The system 104 comprises two primary self-contained subsystems 106, 108, and a third dependent subsystem 110. The details of the first primary subsystem 106 and the dependent subsystem 110 are illustrated in FIG. 10. Applicant's U.S. Pat. No. 3,593,735 entitled "Method and Apparatus For Maintaining a Preselected Partial Pressure" discusses in detail a method and apparatus for mixing a filler gas and oxygen to obtain a preselected oxygen partial pressure level. The output from this mixing process is used to feed the dependent subsystem 110. Applicant hereby incorporates by reference U.S. Pat. No. 3,593,735 and all references cited therein.

The first primary subsystem 106 is the earlier referenced oxygen subsystem. Before the divers enter the capsule 18, the interior of the shell 21 is pressurized to a level compatible with that of the main chamber 14. In addition, the partial pressure of oxygen, as discussed in U.S. Pat. No. 3,593,735, is raised or lowered to a level compatible with that of the main chamber 14. Helium is the principal filler gas which is used to pressurize the capsule 18. Unlike oxygen which is constantly depleted by the breathing process, helium is not. Therefore, once the shell is pressurized to the level representative of the desired pre-selected hydrostatic level with helium, there is no need to further re-pressurize the capsule 18 after it has been lowered overboard. Oxygen, on the other hand, must be periodically replenished to support the divers. Once the apparatus is lowered overboard, the primary oxygen supply is the oxygen bottles secured within the base skid 31.

The oxygen subsystem 106 includes a set of gauges 112, a set of connectors 118, a sensor 119, a control unit 121, a regulator 122, a choke 123, a solenoid valve 124 and a particle filter 130. The connectors 118 connect the oxygen bottles to the oxygen subsystem 106 which is supported on the shell 21. The connectors 118 are standard piping connectors well known in the field for quick-disconnect operation. The particle filter 130 is connected to the connectors 118 and is provided to filter contaminates such as rust or other residual matter which may be present in the bottles. The regulator 122 is connected to the filter 130 and reduces the high oxygen pressure from the oxygen bottles, generally on the order of 2400 psi, to a low pressure level tolerable for release at a controllable rate into the shell. The low pressure is normally 300 psi above the capsule pressure. Such is, however, an arbitrary value large enough to assure a pressure differential between the capsule's atmosphere and the line pressure to provide a workable and controllable uniform gas flow.

The gauges 112 are connected on both sides of the regulator 122 and monitor the high and low pressure across the regulator 122. The sensor 119 is supported inside the shell 21 and monitors the amount of oxygen within the shell. The sensor is connected to the control unit 121 which regulates the amount of oxygen permitted to the enter the shell 21. The operation of the sensor 119 is described in the U.S. Pat. No. 3,593,735 and references cited therein.

The solenoid valve 124 is connected to the low pressure side of regular 122. The control unit is connected to the solenoid valve 124. The solenoid valve 124 is electrically controlled from the unit 121 which receives the output signal from the sensor 119. The solenoid valve 124 is primarily an off/on switch and cannot, therefore, accurately regulate the flow of oxygen into the shell 21. Rather, the choke 123 is connected downstream from the solenoid valve 124 and permits the operator to control the volumetric flow of oxygen into the shell 21. The choke 123 is a standard metering orifice, such as model JETA-187-2300D manufactured by the Lee Co. of West Brook, Connecticut. The orifice is sized such that for a given length of time the amount of oxygen passing the orifice at the specified pressure (300 p.s.i. plus hydrostatic) will yield the partial pressure of oxygen required of the divers. In this manner, the partial pressure of oxygen is accurately monitored and regulated.

The oxygen subsystem also includes a set of intake valves 118A and a set of regulator valves 122A, a regulator bypass valve 122B, a bypass system 126, a bypass valve 127, an emergency bypass system 128, master valve 129, and an output valve 164. The bypass valve 127 is connected on the bypass system 126 that is connected in parallel to the solenoid valve 124 and permits the operator to override the solenoid valve 124 if a malfunction arises. An intake valve 118A is connected between each connectors 118 and the filter 130 to permit oxygen to pass through the particular valve into the filter 130. The master valve 129 is connected on the emergency bypass system 128 which is connected in parallel across the filter 130, the gauges 112 and regulator 122, the solenoid valve 124, and the choke 123.

Before lowering the capsule overboard, all valves on the oxygen subsystem 106 are opened with the exception of the master bypass valve 129. The valve 129 is opened only when the regulator 122 or choke 123 malfunctions. The entire oxygen subsystem 106 from the connector 118 to the output valve 164 is supported on the exterior surface of the shell 21. The output valve 164 is connected to the choke 123; yet, it preferably is supported inside the shell 21. An oxygen monitoring device (not shown), for example a portable, battery operated Teledyne model 320B monitoring device, is mounted in shell 21 behind output valve 164 to indicate the partial pressure of oxygen inside the shell.

As the divers inhale oxygen from the subsystem 106 and exhale carbon dioxide, the pressure level inside the shell 21 increases above the pre-select saturation pressure. Therefore, to release some of the internal pressure within the shell, the breathing system 104 includes an exhaust system 150 having a set of valves 150A. One valve 150A is supported outside the shell 21 and the other inside the shell 21.

The exhaust system 150 is also suitably implemented to release internal pressure by periodically opening both valves 150A to allow excess pressure to escape.

The breathing system also includes a Built-In-Breathing (BIB) oral/nasal mask dump subsystem 156 having a set of oral/nasal masks 160 and regulator 158. The masks 160 are connected to the regulator 158 and are supported within the shell 21. The divers may inhale the oxygen from within the shell 21 through the mask 160. On exhale, the additional pressure buildup due to exhalation opens the regulator 158 allowing the exhaled gasses to exit the shell 21. Essentially, the regulator 158 acts as a one-way valve opening on exhalation to allow the gas to exit the shell. Thus, the pressurization within the shell does not increase since the exhaled volume is continuously discharged from the shell. There is no need, therefore, to implement the exhaust system 150 if the BIB dump subsystem 156 is used.

The dependent breathing subsystem 110 includes a premixed combination of helium and oxygen prepared onboard the support vessel. U.S. Pat. No. 3,593,735 discloses in detail a mixing tank for obtaining the proper concentrations of helium and oxygen. With reference to FIG. 10, the dependent breathing system 110 comprises a helium oxygen ($HeO_2$) subsystem 132 having a set of connectors 132A, a particle filter 130, loader regulator 134, static line 134A, dome regulator 136, bypass system 142 and control valve 162.

The $HeO_2$ subsystem 132 is dependent on the presence of the support vessel for a continuous supply of premixed gas and is, hence, used only when the main decompression chamber is damaged. The $HeO_2$ subsystem 132 is fed by a mixing tank (not shown) as discussed in U.S. Pat. No. 3,593,375. The particle filter 130 is connected to the connections 132A to remove any contaminating particles such as rust or other residual matter from the system. The line from a mixing tank (not shown) is connected to connectors 132A which are standard piping connectors well known in the field for quick-disconnect operation.

To accurately maintain a specified level of pressurization within the shell 21, a loader regulator 134 such as model 15L manufactured by Grove Valve and Regulator Co., Inc. of Oakland, California is used. The loader regulator 134 allows an accurate monitorization of the desired pressurization level by permitting a very fine adjustment of the output pressure which is static along the line 134A. Regulator 134 is connected to the filters 130 and static line 134A. The static pressure within line 134A is actually the value of the low pressure desired within the shell 21. The loader regulator 134 regulates the operation of the dome regulator 136 via the static line 134A.

The dome regulator 136 is a standard diaphragm driven regulator, such as model WBX manufactured by the Grove Valve and Regulator Co., Inc. The dome regulator 136 is connected to the filter 130 parallel to the loader regulator 134. The static line 134A, however, is connected to the dome regulator 136. The dome regulator 136 will only permit a low pressure similar to that in the static line 134A to leave the downstream end of the regular 136. The static pressure depresses a diaphragm which permits a downstream pressure from the regulator 136 no greater than the static line pressure. The dome regulator 136 will automatically deactivate due to its diaphragm driven operation should any malfunction of the regulator arise. The $HeO_2$ subsystem 132 includes a bypass 142 connected in parallel across the dome regular 136 and loader regulator 134. The by-pass 142 is included in the $HeO_2$ subsystem 132 to permit a manual release of the gas into the shell should the regulator 136 cease operating. The $HeO_2$ subsystem 132 also includes a set of gauges 114 connected on either side of the loader regulator 134 to monitor the high and low pressures. The control valve 162 is connected to the downstream side of the dome regulator 136 to close off the system. The entire $HeO_2$ subsystem 132 from the connections 132A to the control valve 162 is supported on the exterior surface of the shell 21.

The breathing system 104 also includes a helium (He) subsystem 133. The structure of the He subsystem 133 is similar to the $HeO_2$ subsystem 132 discussed above. Helium is used only as a filler gas to pressurize the capsule to a pressure level similar to that of the main decompression chamber. Once pressurized, the divers may easily open the capsule's door and transfer into the shell 21. Since helium is not depleted with time, there is no need to repressurize the capsule. The operation of the helium subsystem 133 is substantially identical to the $HeO_2$ subsystem 132.

The breathing system 104 also includes a BIB subsystem 140. The BIB subsystem 140 is similar to the $HeO_2$ subsystem 132 except that it includes a set of oral/nasal masks 146 which are supported within the shell 21 and through which the injected gas is inhaled. The masks 146 are connected to the downstream side of the dome regulator 136A. The BIB subsystem 140 is used whenever the divers wish to breath the $HeO_2$ directly from the mixing tank without first releasing it into the capsule's atmosphere. In this manner, the amount of mixture actually inhaled can be more accurately monitored.

The breathing system 104 includes a sample subsystem 148 and a depth gauge subsystem 144. The sample subsystem 148 includes a set of control valves 148A connected in series. One valve is supported within the shell 21 and the other is supported outside the shell 21. The sample subsystem 148 is used to obtain a sample of the gas from the interior of the capsule for quality control purposes. A sample of gas is retrieved simply by opening both control valves 148A. The depth gauge subsystem includes a set of gauges 144A and a set of the valves 144B. The depth gauges 144A are connected in parallel to the valves 144B and are supported on the exterior surface of shell 21. The gauges 144A independently monitor the pressure inside the capsule and project the reading in terms of water depth.

In an emergency situation with the capsule 18 floating freely at sea, only the oxygen subsystem 106, the BIB dump subsystem 156, the exhaust subsystem 150, and depth gauge subsystem 144 are operative. The oxygen containers 57 are connected to the oxygen subsystem 106 by the connectors 118 prior to lowering the capsule overboard the support vessel. Using output valve 164, the diver manually adds oxygen into the shell 21 until the oxygen monitoring device indicates the proper level of partial pressure of oxygen in the shell.

In one embodiment, four oxygen containers are filled to 2400 psi and supported within the base skid 31. This can sustain six divers for approximately 20 hours. Alternatively, the divers may inhale the oxygen through the BIB subsystem 140 if the oxygen containers are connected to this subsystem. Caution should be exercised, however, when inhaling pure oxygen through the BIB subsystem 140 since pure oxygen is highly poisonous beyond a gauge pressure of two atmospheres in the shell.

Figure 11:
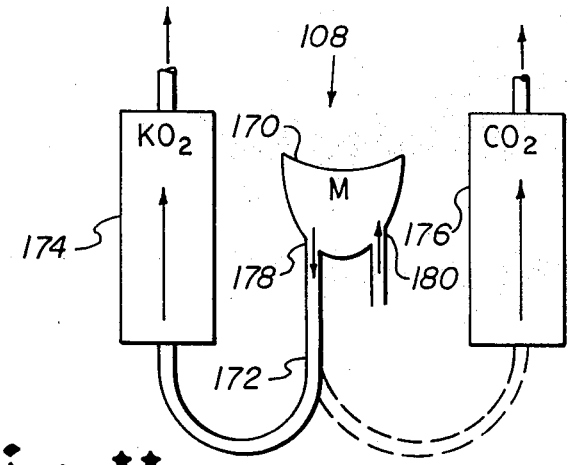
FIG. 11 is a schematic diagram of a potassium superoxide ($KO_2$)/carbon dioxide ($CO_2$) chemical regeneration breathing subsytem used in connection with the emergency capsule.

The second self-contained breathing subsystem 108 comprises a potassium superoxide ($KO_2$)/carbon dioxide ($CO_2$) chemical regeneration breathing system. FIG. 11 is a schematic of the chemical regeneration breathing subsystem as employed in this invention.

The $KO_2/CO_2$ system 108 includes an oral/nasal mask 170, a connection hose 172, a $KO_2$ canister 174, and a $CO_2$ canister 176. The hose 172 is initially connected to the exhalation port 178 of mask 170. The hose 172 is connected at its other end to the $KO_2$ canister 174. Each diver initially inhales breathing gas from the capsule's atmosphere through an inhalation port 180 of the oral/nasal mask 170 and exhales through the hose 172 connecting the mask to the $KO_2$ canister 174. The $KO_2$ canister 174 absorbs $CO_2$ and water from the exhaled gas and releases $1\frac{1}{2}$ moles of oxygen into the atmosphere for each mole of $CO_2$ and water absorbed. In this manner, oxygen is inhaled from the capsule's atmosphere, and exhaled gasses, passing through the $KO_2$ canister, regenerate oxygen back into the capsule's atmosphere. Gradually, the oxygen level within the capsule increases since the amount of oxygen produced is slightly larger than the amount inhaled. The use of $KO_2$ canisters to generate oxygen is well-known.

At a predetermined point wherein the oxygen level is considered excessive (as would be indicated by the oxygen monitoring device in the shell), the divers disconnect their hose 172 from the $KO_2$ canister 174 and reconnect it to the $CO_2$ canister 176, known as a "scrubber" or "absorber", as indicated by the dashed line in FIG. 11. The primary ingredient of the $CO_2$ canister is soda lime or sodium hydroxide which reacts with the exhaled $CO_2$ to produce water and $Na_2CO_3$. As oxygen is inhaled from the capsule's atmosphere and exhaled through the $CO_2$ canister 176, the oxygen level within the capsule begins to decrease approaching a safer level. The exhaled gas, which is primarily $CO_2$, is removed by the $CO_2$ canister. In this manner, $CO_2$ is not exhaled into the atmosphere. As indicated, the use of a $CO_2$ canister to remove $CO_2$ is well-known.

After the oxygen level returns to a predetermined safe level, the divers reconnect their hose 172 to the $KO_2$ canister 174. If the $CO_2$ level in the atmosphere is too high and inhalation from the atmosphere undesirable, the hose may be disconnected from the exhalation port 178 on the mask 170 and reconnected to the inhalation port 180 of the mask 170. The diver may then inhale through the $CO_2$ canister 176 removing $CO_2$ from the air.

Thus, the alternate self-contained breathing subsystem comprises a chemical regeneration process wherein the divers alternate between the $KO_2$ and $CO_2$ canisters cyclically increasing and decreasing the oxygen level.

In one embodiment, four $KO_2$ canisters, containing approximately 24 lbs. of $KO_2$ each, are attached to the bottom interior of the shell, while four $CO_2$ canisters, containing approximately 5 lbs. of soda lime each, are attached to the top interior surface of the shell 21. The chemical regeneration breathing subsystem can sustain six men for approximately 30 hours. It is necessary, however, to continue on the chemical regeneration system once the $KO_2$ canister is initially activated since the chemicals begin to deteriorate once exposed to the atmosphere. Therefore, the divers would decide which of the oxygen subsystem or the $KO_2/CO_2$ chemical regeneration subsystem 108, to implement first.

In actual operation, support personnel on board the parent vessel would initially pressurize the capsule to the desired pressurization with the He subsystem 133 and $O_2$ subsystem 106 or pre-mixed $HeO_2$ subsystem 132. Once pressurized to the proper level including the correct partial pressure of oxygen, the divers would enter the shell 21 through the passageway 20, closing the capsule's door after entry. If the capsule is to be lowered overboard, the oxygen containers supported within the base skid 31 are connected to the oxygen subsystem 106. As mentioned above, the partial pressure of oxygen within the shell is displayed to the divers by an oxygen monitoring device. The control valves 148A, 162 are then closed, and the capsule 18 is disconnected from the main chamber 14 and lowered overboard. Once floating independent of any support from the parent vessel, the divers may continue to breath oxygen from the subsystem 106 so long as the pressure inside the vessel does not exceed 2 atmg.

Alternatively, the divers may close the master valve 164 and initiate the $KO_2/CO_2$ chemical breathing subsystem 108. Once the $KO_2$ and $CO_2$ canisters are depleted, the divers may then re-open the master valve 164 implementing the oxygen subsystem 106. As the pressure within the capsule increases due to exhalation, the divers may release excess pressure via the exhaust subsystem 150.

On the other hand, the divers may exhale through the BIB dump subsystem 156, thereby preventing the buildup of pressure due to exhalation, or they may inhale oxygen through the BIB subsystem 140 if the oxygen containers are connected to this subsystem and its control valve 162 is not closed at lowering. Once retrieved, the capsule is raised on board a rescue vessel and aligned to properly seal the capsule to an alternate main decompression chamber by means of the levelling mandrels. The pressure of the main chamber 14 is then elevated to the same pressure as the capsule 18 and the divers are transferred back to the larger living quarters of the chamber 14.

If the main decompression chamber 14 is abandoned and the support vessel is not abandoned, the divers will remain inside the capsule 18 on board the support vessel. The capsule 18 can be connected to a pre-mixed concentration of $HeO_2$ prepared according to U.S. Pat. No. 3,593,735 and fed into the capsule via the $HeO_2$ subsystem 132.

This invention represents a novel method and apparatus for supporting saturation divers in an emergency situation. Unlike a diving bell, the capsule does not descend beneath the water surface. The structure is designed to float at the water surface maintaining the desired pressurization. The unit is completely self-contained. Using both self-contained breathing subsystems, the described embodiment can support six divers for a total of 50 hours.

Thus, it is apparent that there has been provided an invention which satisfies the objective set forth above. Further modifications and alternate embodiments of the invention will be apparent to those skilled in the art in view of this description. Accordingly, this description is to be considered as illustrative only and is for the purpose of teaching those skilled in the art the manner of carrying out the invention. Various changes may be made in the shape, size, and arrangement of parts. For example, equivalent elements and materials may be substituted for those illustrated and described. It is intended that all such alternatives, modifications, and variations which fall within the spirit and scope of the invention as defined in the appended claims be embraced thereby.

What is claimed is:

1. A Life support system for saturation divers, which comprises:

a decompression chamber adapted to be mounted on the deck of a support vessel floating on the surface of a body of water for housing a diver in a pressurized atmosphere of a predetermined pressure;

a diving bell adapted for attachment to the decompression chamber and for transporting a diver from the surface support vessel to underwater work location and back to the surface support vessel; and a hyperbaric life boat capsule adapted to be supported on the deck of the surface support vessel adjacent the decompression chamber for connection thereto by connecting means that sealingly couples the capsule to the decompression chamber and provides for detachment of the capsule, the capsule being adapted for launching from the surface support vessel to float freely and independently therefrom at the water surface.

2. The system of claim 1 wherein the hyperbaric life boat capsule comprises:

a shell structure having an exit;

means for stabilizing the shell in open seas; and a source of breathable air for occupants of the shell.

3. The system of claim 1 wherein the connecting means comprises a pair of mating flanges that defines a passageway between the decompression chamber and the capsule providing for movement of divers therebetween.

4. The system of claim 1 wherein the hyperbaric life boat capsule comprises:

a shell structure having an exit therein defined as a passageway by one of a mating pair of flanges that comprises the connecting means;

a support assembly for supporting the shell on the deck of the support vessel;

a stabilization ring for stabilizing the shell during floatation in open sea; and a source of breathable air for sustaining occupants of the shell.

5. The system of claim 4 wherein the breathable air source for the shell comprises:

a container of oxygen supported on the shell;

means for introducing pressure and oxygen into the shell from a source of pressure and a source of oxygen on board a support vessel to sustain divers when the capsule is maintained on board the support vessel; and means for introducing oxygen into the shell from the container of oxygen supported on the shell to sustain divers when the capsule is launched and allowed to float freely from the support vessel.

* * * * *